US008636228B2

(12) United States Patent
Lo

(10) Patent No.: US 8,636,228 B2
(45) Date of Patent: Jan. 28, 2014

(54) WATER PASSAGE FOR EMBEDDED ROTARY SPRINKLER

(76) Inventor: Shun-Nan Lo, Taichung (TW)

( * ) Notice: Subject to any disclaimer, the term of this patent is extended or adjusted under 35 U.S.C. 154(b) by 442 days.

(21) Appl. No.: 12/662,578

(22) Filed: Apr. 23, 2010

(65) Prior Publication Data

US 2011/0259977 A1 Oct. 27, 2011

(51) Int. Cl.
*B05B 3/04* (2006.01)

(52) U.S. Cl.
USPC ..... 239/222.17; 239/222.13; 239/240

(58) Field of Classification Search
USPC ..... 239/15, 222.15, 222.17, 222.13, 240, 239/237, 239
See application file for complete search history.

(56) References Cited

U.S. PATENT DOCUMENTS 5,052,621 A * 10/1991 Katzer et al. ..... 239/242
5,676,315 A * 10/1997 Han ..... 239/590

* cited by examiner

*Primary Examiner* — Len Tran
*Assistant Examiner* — Viet Le
(74) *Attorney, Agent, or Firm* — Raymond Y. Chan; David and Raymond Patent Firm

(57) ABSTRACT

A water passage for embedded rotary sprinkler includes upper and lower tubes and upper and lower covers so as to form first and second independent chambers, integral water path, and upper and lower independent chambers. The first and lower independent chambers has clockwise and counter-clockwise water paths. An outer ring water path connecting the first independent chamber is formed to the lower tube. A transmission gear is arranged inside the second independent chamber. A driving shaft having an upward open is arranged between the second and the lower independent chambers. An upper end of the driving shaft is connected by a nozzle, and a plurality of lateral hole is formed to a middle of the driving shaft in the upper independent chamber. A lower end of the driving shaft having a gear engaging the transmission gear is inside the second independent chamber.

20 Claims, 19 Drawing Sheets

WATER PASSAGE FOR EMBEDDED ROTARY SPRINKLER

FIELD OF THE INVENTION

The present invention relates to sprinkler, and particular to a water passage for embedded rotary sprinkler capable of releasing pressure automatically so as to prevent a breakage of component.

DESCRIPTION OF THE PRIOR ART

Published patents such as U.S. Pat. Nos. 7,478,526, 7,434,747, 6,929,194, and 6,840,460 disclose different water flow passages and methods for alternate rotation of sprinkler. However, without a pressure release function, leak will easily happened between components under a high water pressure.

Therefore, through many trials and experiments, the inventor of the present invention provide a water passage for embedded rotary sprinkler capable of releasing pressure automatically.

SUMMARY OF THE PRESENT INVENTION

The primary object of the present invention is to provide an embedded rotary sprinkler capable of releasing pressure automatically. To achieve the object, the present invention having water paths assembled by upper and lower tubes and covers will release excess pressurized water to prevent a breakage.

DETAILED DESCRIPTION OF THE INVENTION

Figure 1:
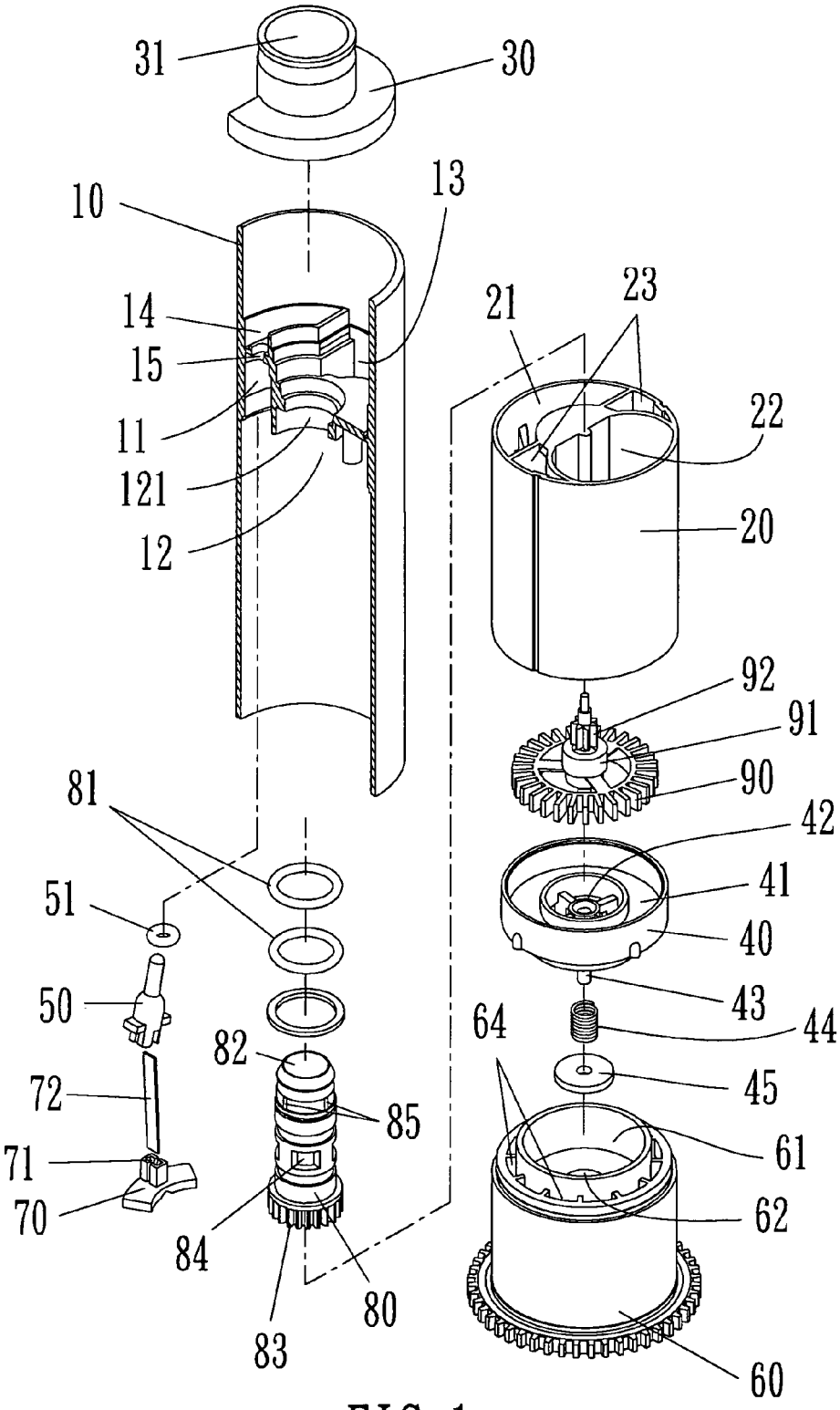
FIG. 1 is an exploded view showing a preferable embodiment of the present invention.
Figure 2:
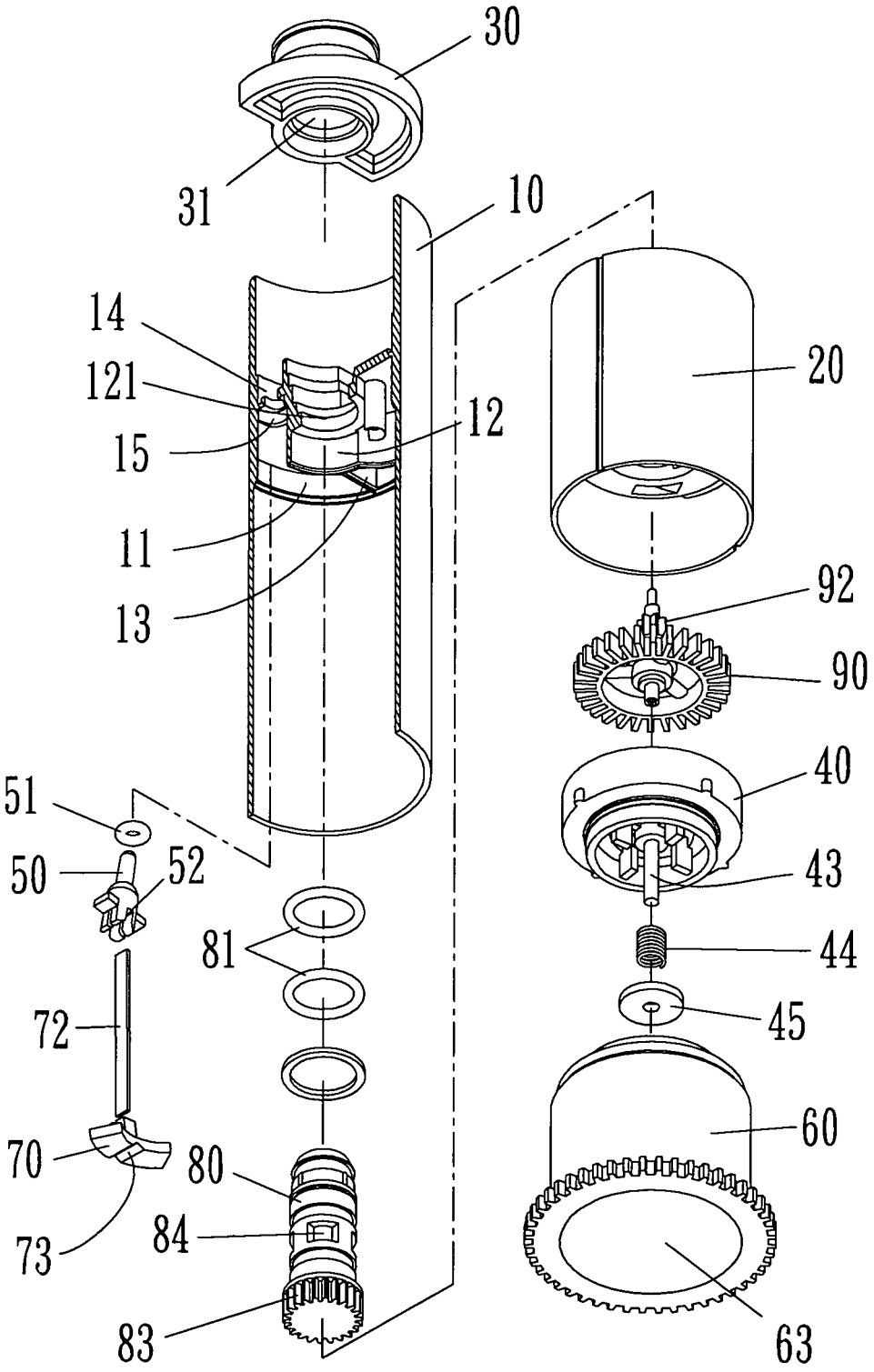
FIG. 2 is another exploded view showing the preferable embodiment of the present invention.
Figure 3:
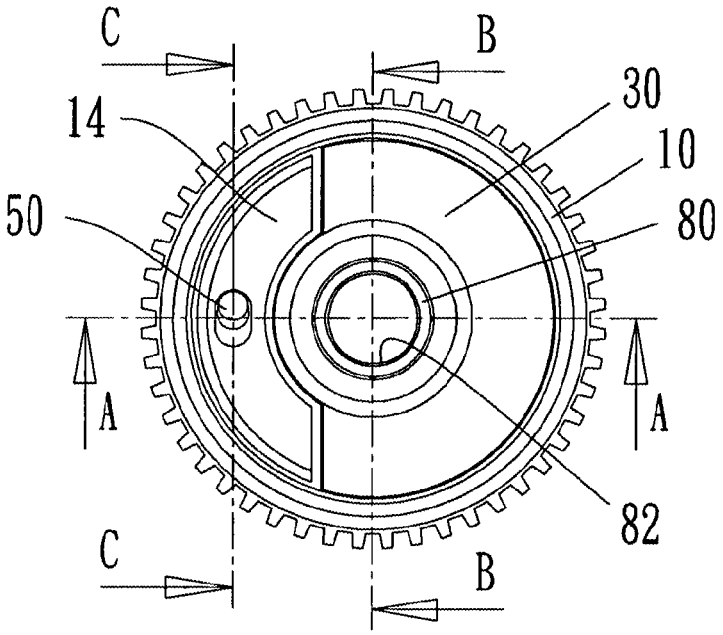
FIG. 3 is a top view of the preferable embodiment of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 10, a water passage for embedded rotary sprinkler according to the present invention is illustrated. The water passage for embedded rotary sprinkler includes an upper tube 10, lower tube 20, upper cover 30, and a lower cover 40. A first independent chamber 100, second independent chamber 200, integral water path 300, upper independent chamber 400, and a lower independent chamber 500 are formed inside of embedded rotary sprinkler. The first independent chamber 100 communicates with the lower independent chamber 500. The lower independent chamber 500 communicates with the integral water path 300. The integral water path 300 communicates with the upper independent chamber 400. A circuitous path of water is formed.

The above components are further described in the following.

Referring to FIGS. 11 to 14, the upper tube 10 has a first upper receiving chamber 11 and a second upper receiving chamber 12 inside thereof. An upper water path 13 is formed between the first and the second upper receiving chamber 11 and 12. A top receiving chamber 14 is formed separately to a top of the upper receiving chamber 11. The upper cover 30 is arranged to the top receiving chamber 14 so that the upper independent chamber 400 is formed between the upper cover 30 and a relative top of the second upper receiving chamber 12. A through hole 15 is formed between the first upper receiving chamber 11 and the top receiving chamber 14. A water seal ring 51 and a rod 50 are arranged to the through hole 15. The water seal ring 51 is arranged between the through hole 15 and the rod 50 so that the rod 50 is positioned and capable of swinging left and right. An upper axial through hole 121 is formed to a top of the second upper receiving chamber 12. A first upper axial hole 122 and second upper axial hole 123 are formed next to the upper axial through hole 121 with a predetermined gap. A recess 52 is formed to a bottom of the rod 50 so as to receive a top of a long twisting sheet 72.

Figure 6:
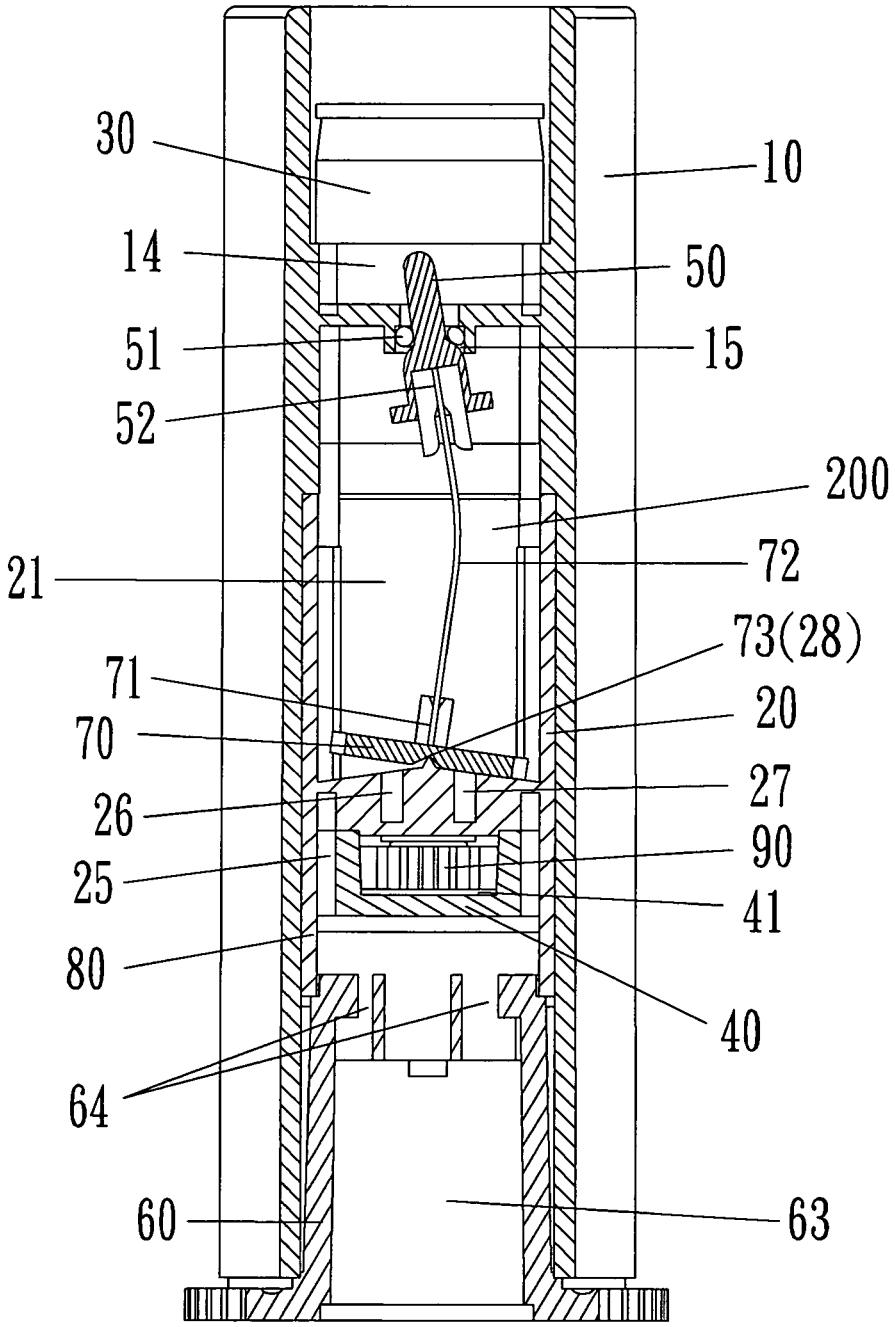
FIG. 6 is a cross-section view through a C-C line of the FIG. 3.
Figure 7:
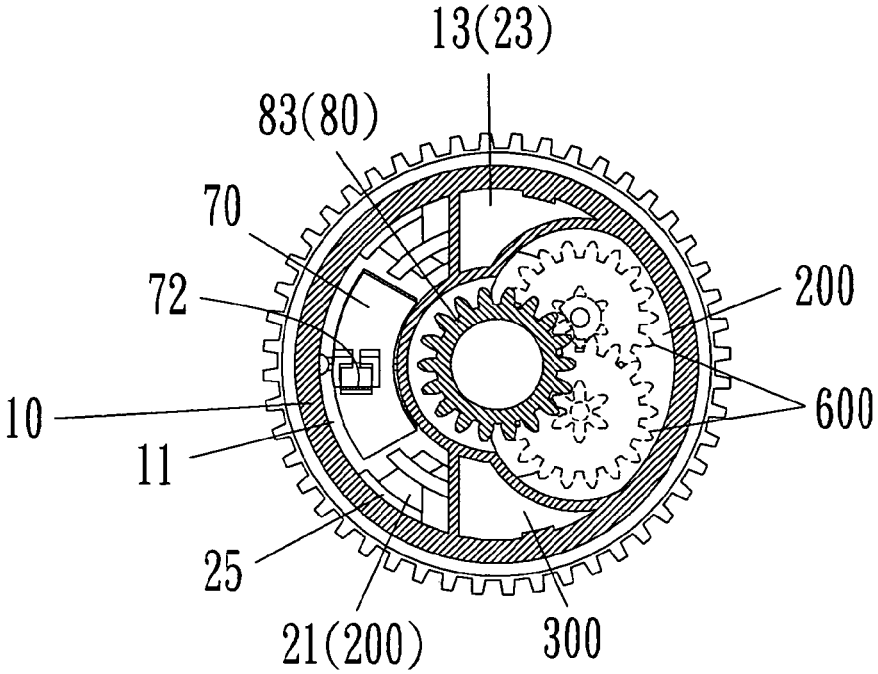
FIG. 7 is a cross-section view through a D-D line of the FIG. 3.
Figure 8:
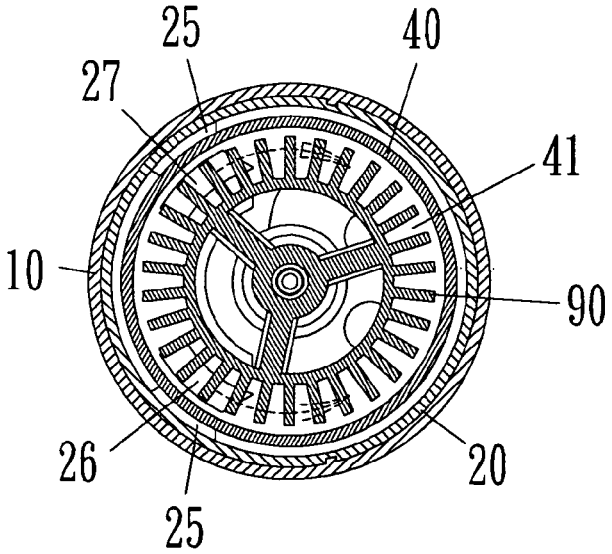
FIG. 8 is a cross-section view through a E-E line of the FIG. 3.
Figure 9:
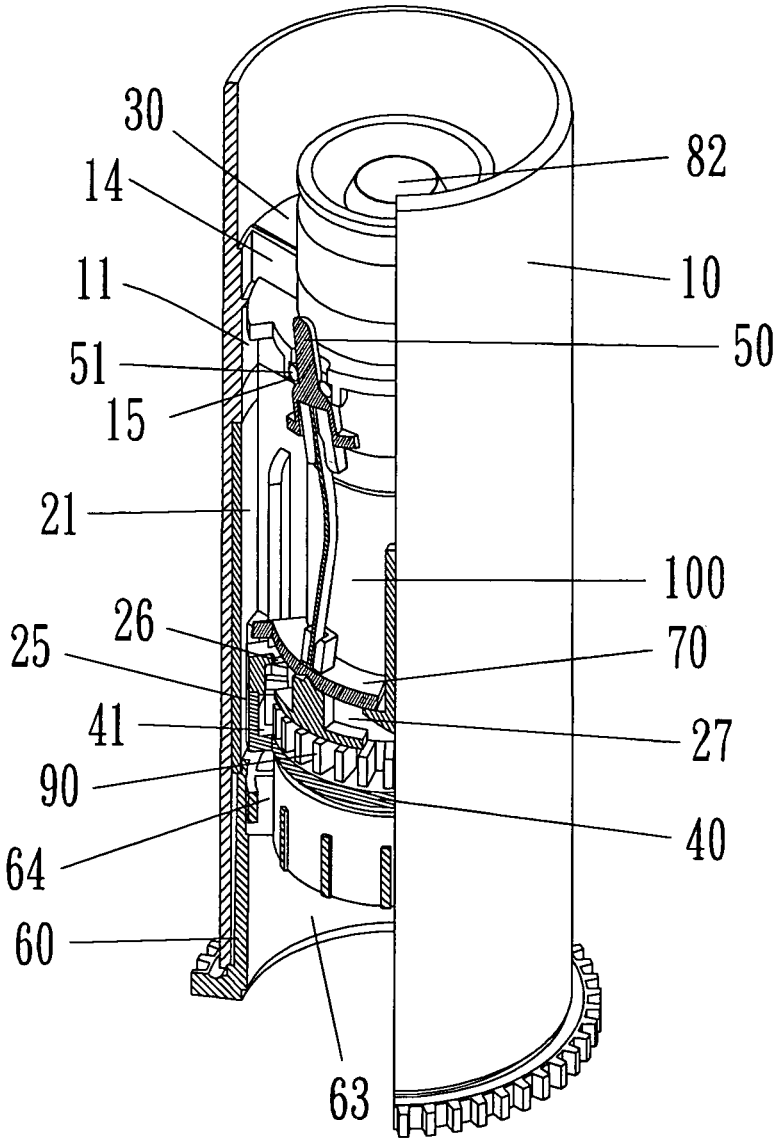
FIG. 9 is a cross-section view showing the preferable embodiment of the present invention.
Figure 10:
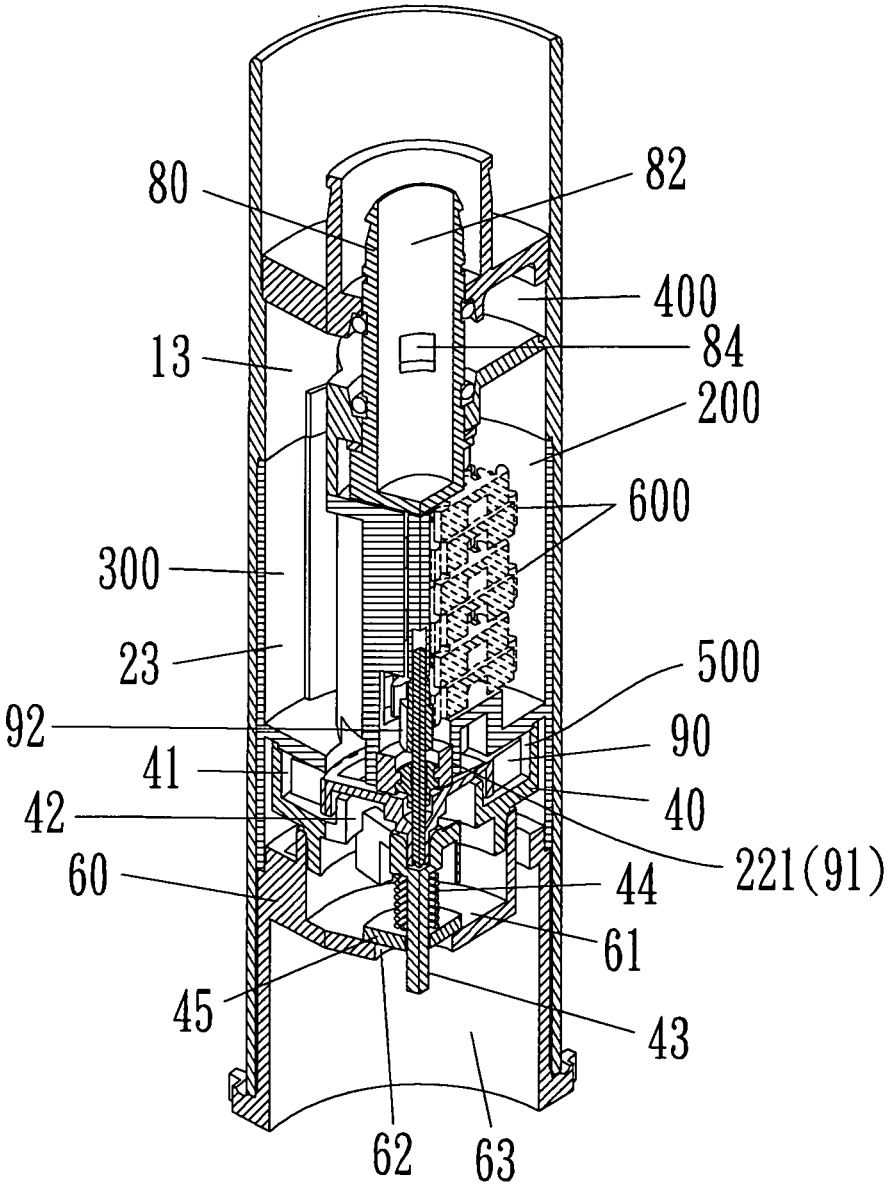
FIG. 10 is another cross-section view showing the preferable embodiment of the present invention.
Figure 11:
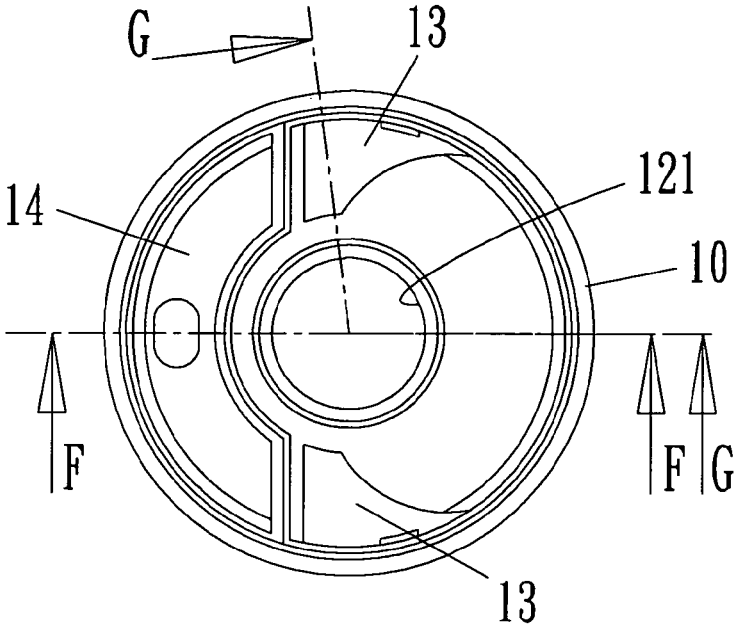
FIG. 11 is a top view showing an upper tube of the present invention.
Figure 12:
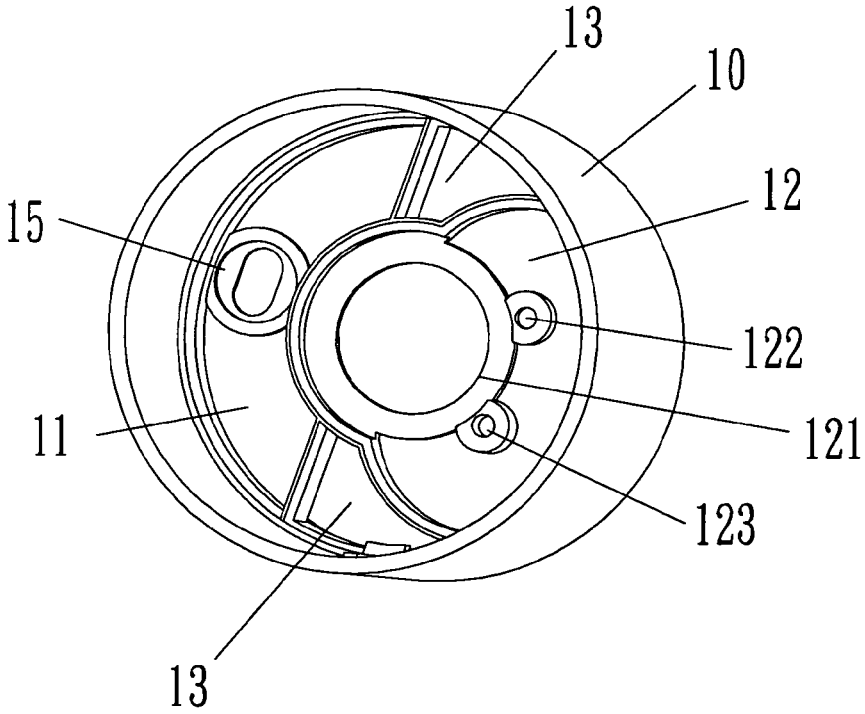
FIG. 12 is an upward stereograph showing the upper tube of the present invention.
Figure 13:
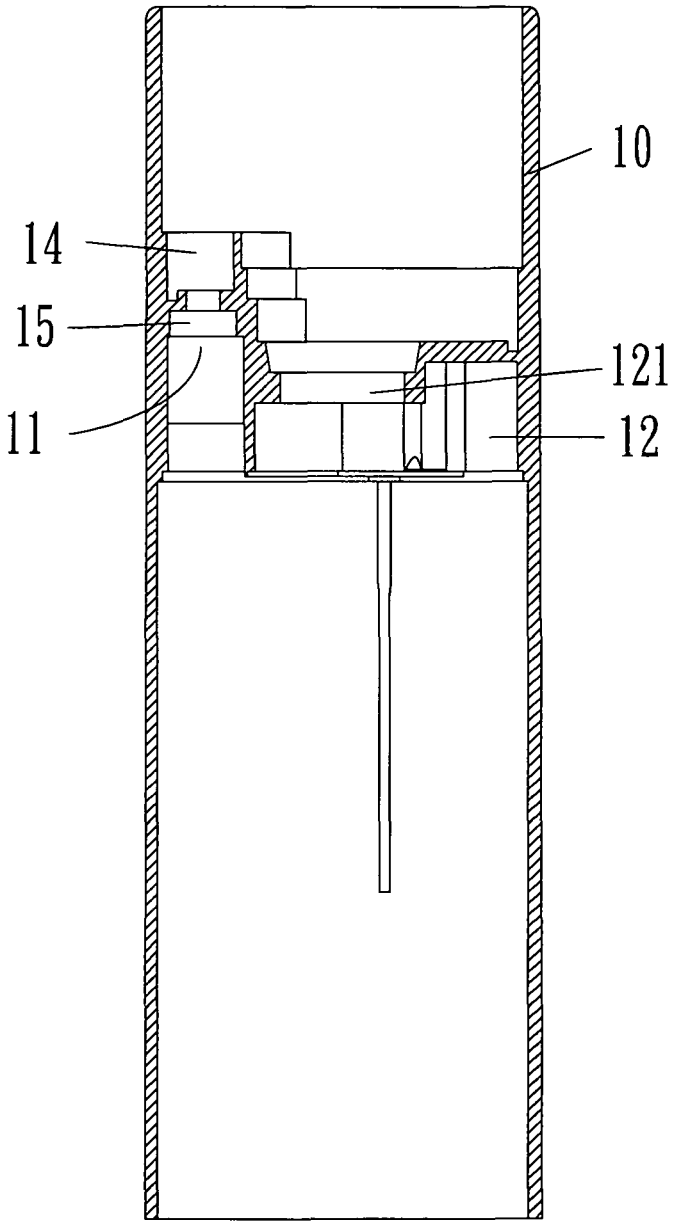
FIG. 13 is a cross-section view through a F-F line of the FIG. 11.
Figure 14:
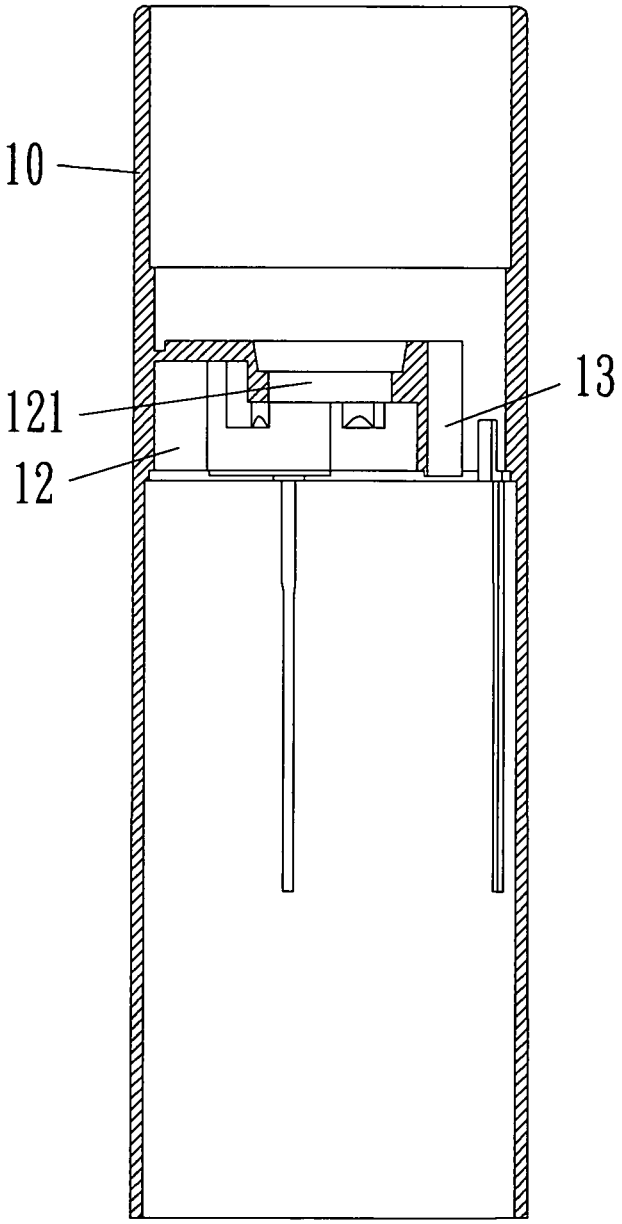
FIG. 14 is a cross-section view through a G-G line of the FIG. 11.
Figure 15:
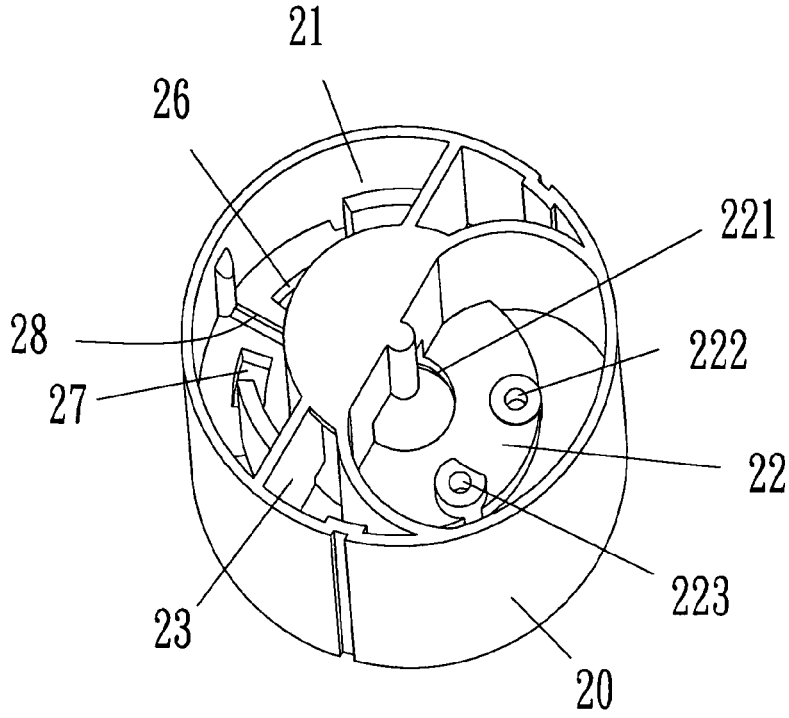
FIG. 15 is a vertical stereograph showing a lower tube of the present invention.
Figure 16:
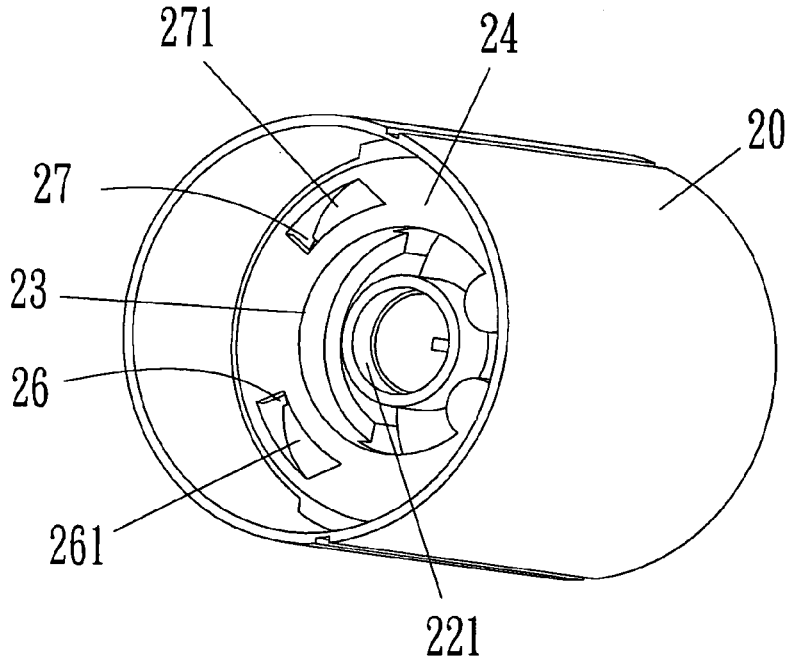
FIG. 16 is an upward stereograph of the lower tube of the present invention.
Figure 17:
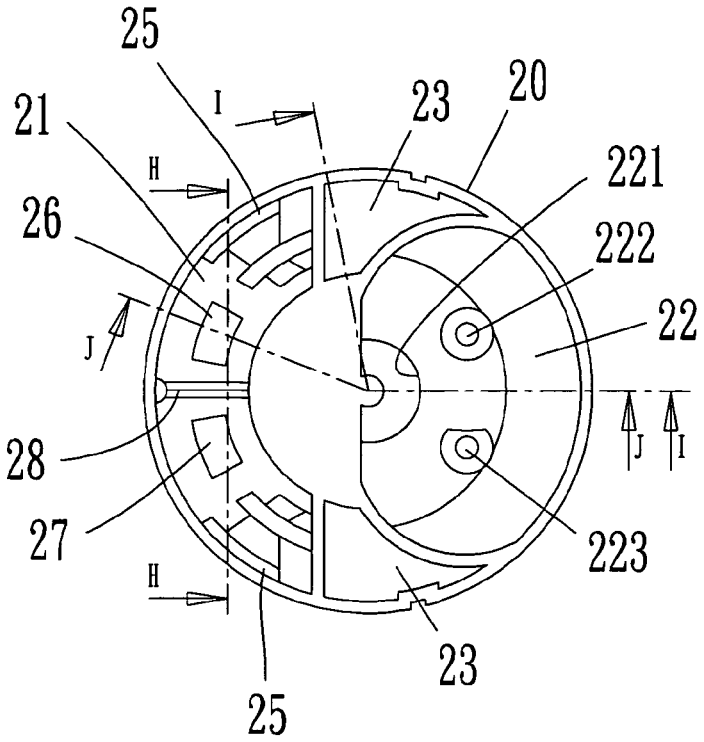
FIG. 17 is a top view of the lower tube of the present invention.
Figure 18:
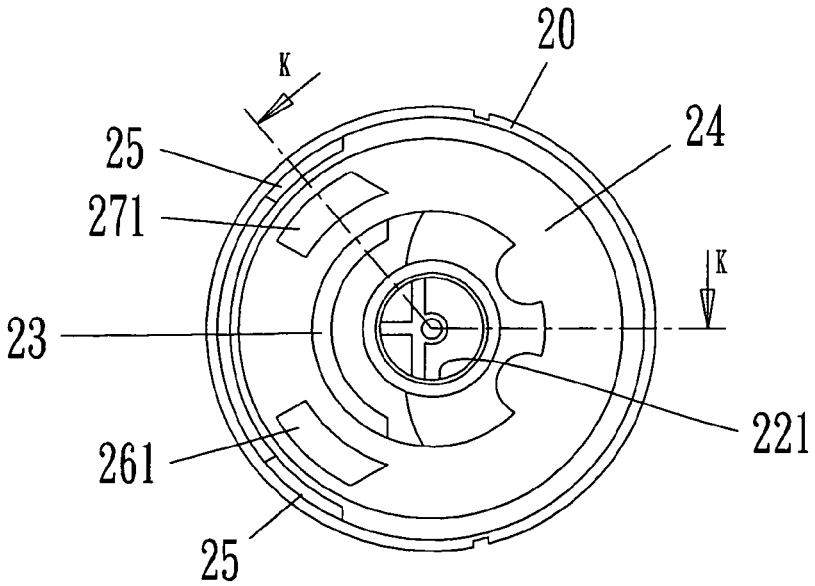
FIG. 18 is an upward view of the lower tube of the present invention.
Figure 20:
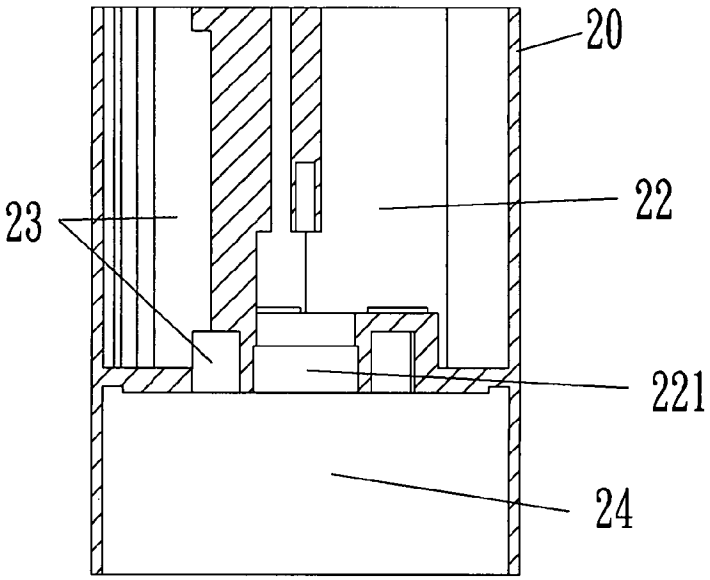
FIG. 20 is a cross-section view through an I-I line of the FIG. 17.
Figure 19:
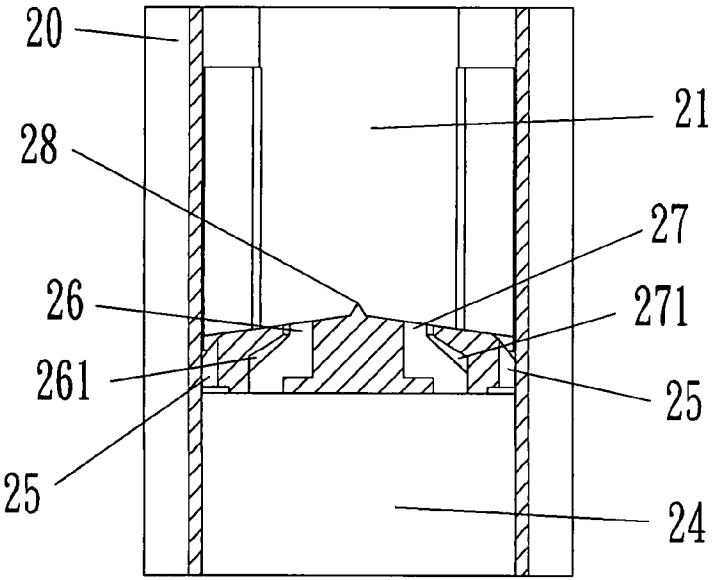
FIG. 19 is a cross-section view through a H-H line of the FIG. 17.
Figure 22:
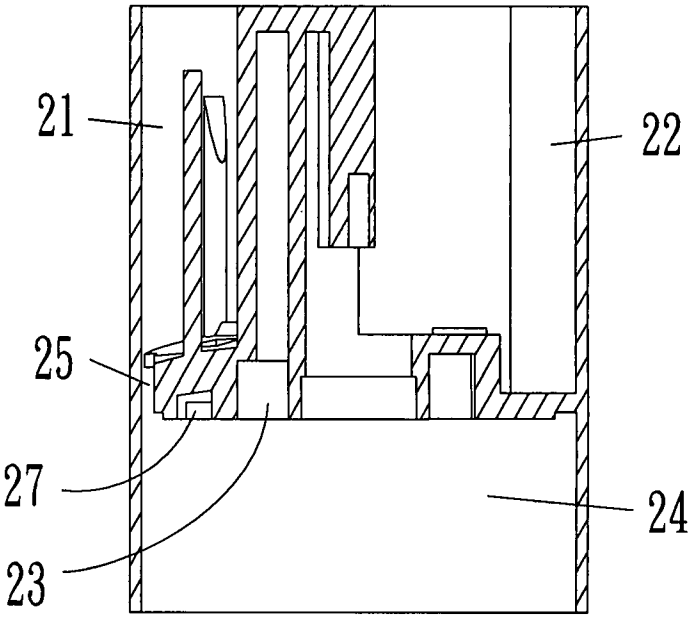
FIG. 22 is a cross-section view through a K-K line of the FIG. 17.
Figure 21:
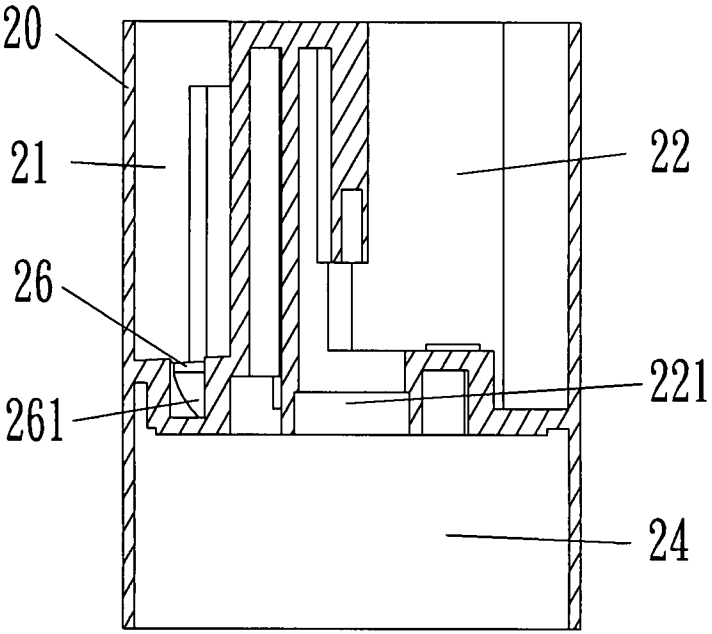
FIG. 21 is a cross-section view through a J-J line of the FIG. 17.

Referring to FIGS. 15 to 22, the lower tube 20 has a first lower receiving chamber 21, second lower receiving chamber 22, lower water path 23, and lower receiving space 24. A bottom of the lower receiving space 24 can be connected to a bottom tube 60. A top of the lower receiving space 24 below the first lower receiving chamber 21 has a linked outer ring water path 25, clockwise water path 26, and count-clockwise water path 27. An awl-shaped column 28 is formed between the clockwise water path 26 and the count-clockwise water path 27. A splitter 70 is arranged to the awl-shaped column 28. The twisting sheet 72 is arranged to a recess 71 formed to a top of the splitter 70. The twisting sheet 72 linked to the rod 50 will drive the splitter 70 to block the clockwise water path 26 or the count-clockwise water path 27. An awl-shaped recess 73 is formed to a bottom center of the splitter 70 so as to engage the awl-shaped column 28 as shown in FIG. 6. A lower axial hole 221 is formed to a bottom of the second lower receiving chamber 22. A first lower axial hole 222 and second lower axial hole 223 are formed next to the lower axial hole 221. The lower water path 23 is formed to two lateral sides of the first and second lower receiving chambers 21 and 22. A bottom of the lower water path 23 communicates with the lower receiving chamber 24. Referring to FIGS. 8, 16, and 19, an outlet of the clockwise water path 26 has a right slope 261 inclined from up to down, left to right so as to form a clockwise water flow. An outlet of the counterclockwise water path 27 has a left slope 271 inclined from up to down, right to left so as to form a counterclockwise water flow.

Figure 4:
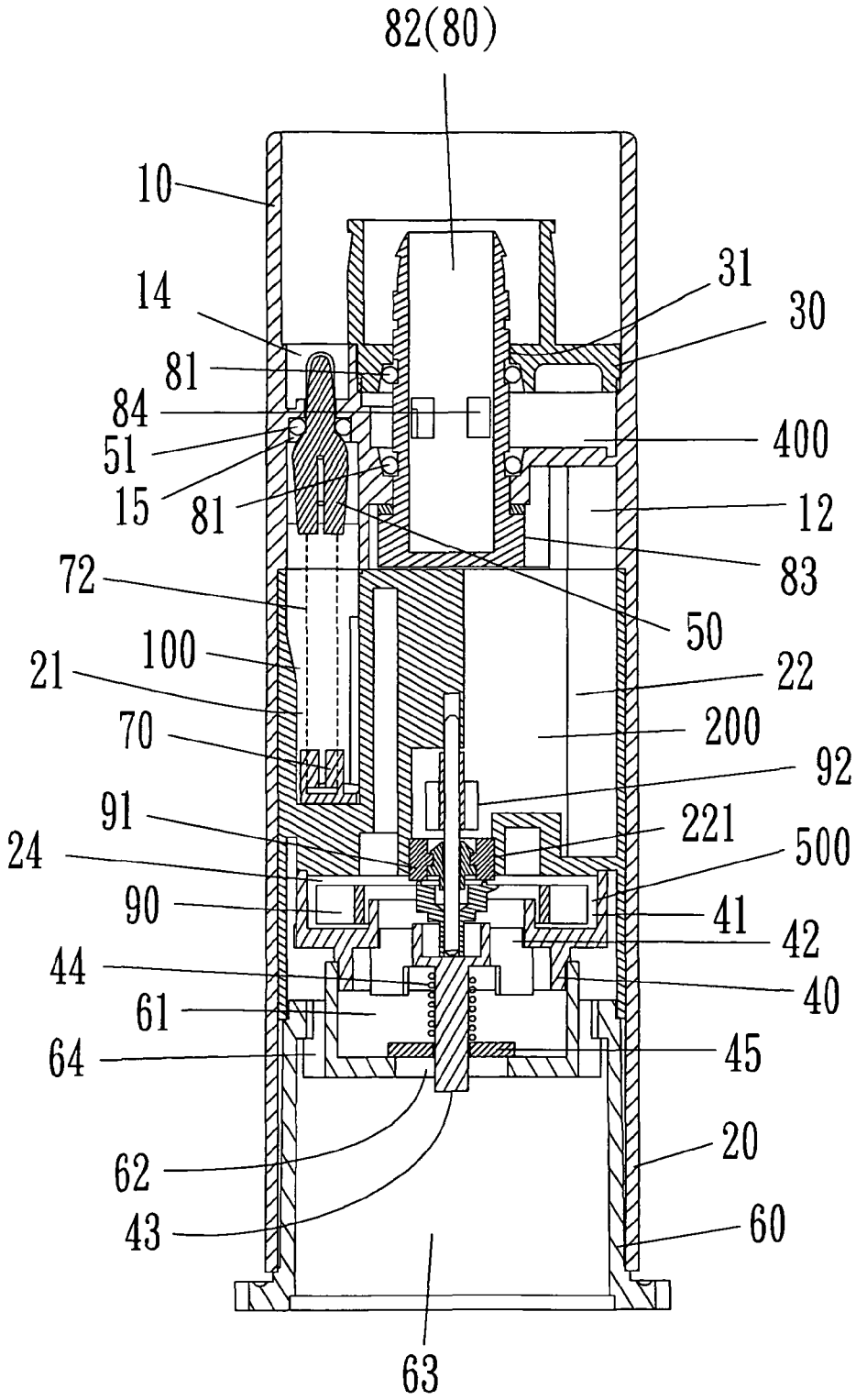
FIG. 4 is a cross-section view through an A-A line of the FIG. 3.
Figure 5:
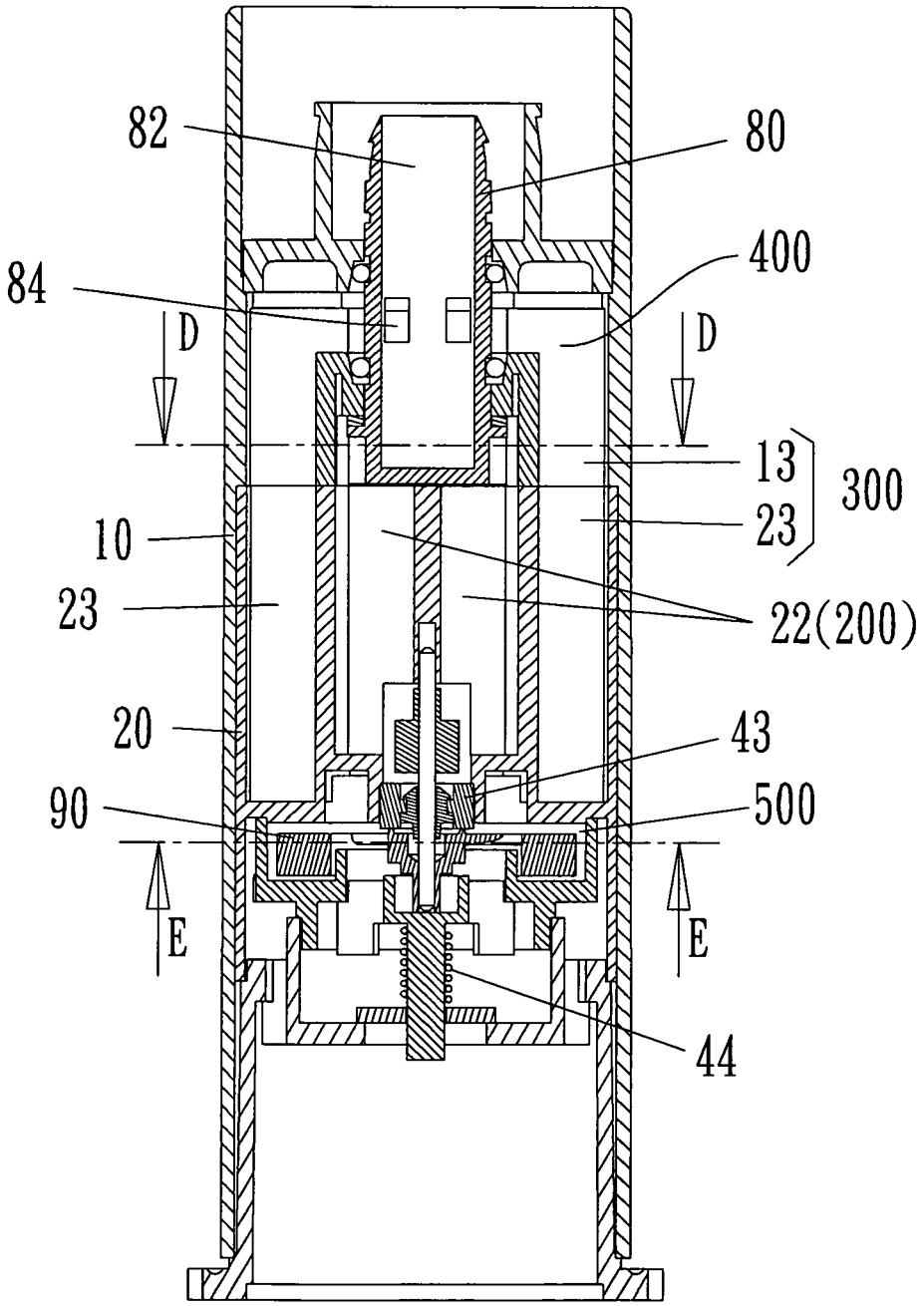
FIG. 5 is a cross-section view through a B-B line of the FIG. 3.
Figure 24:
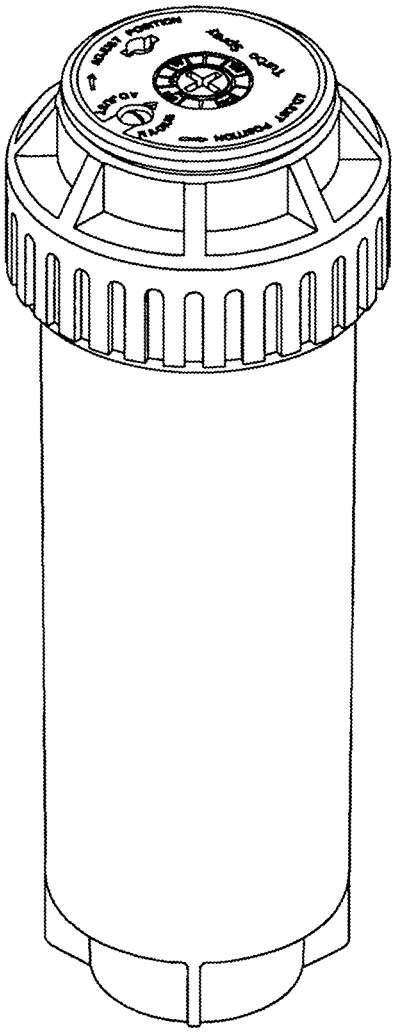
FIG. 24 is a schematic view showing an embedded rotary sprinkler of the present invention.
Figure 25:
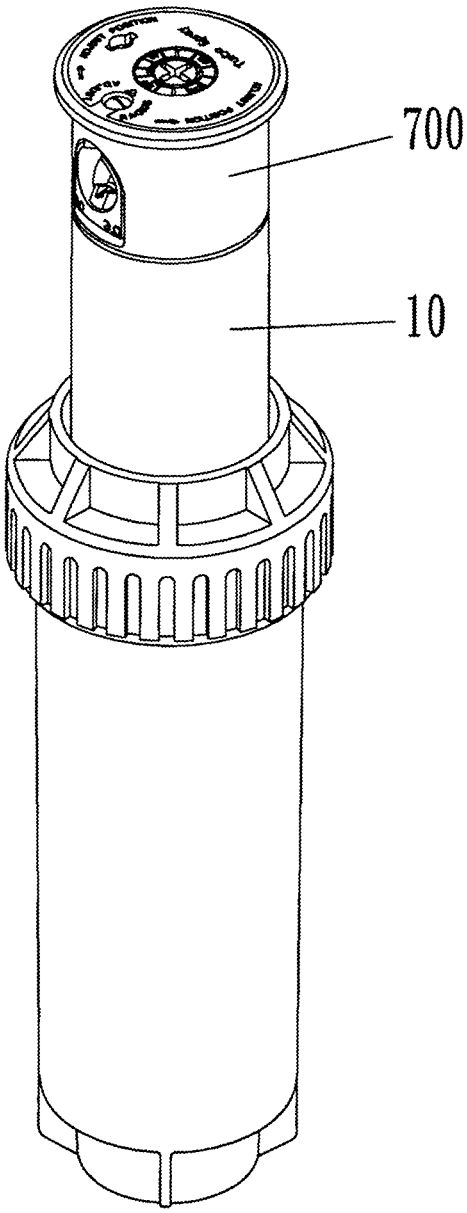
FIG. 25 is a schematic view showing an operation of the embedded rotary sprinkler of the present invention.

Referring to FIGS. 1, 4, 5, the upper cover 30 has an axial hole 31. The upper cover 30 is fixed to a predetermined position above the second upper receiving chamber 12 and beside the top receiving chamber 14 inside the upper tube 10 so that the upper independent chamber 400 is formed. The axial hole 31 is aligned with the upper axial hole 121 of the second upper receiving chamber 12. A driving shaft 80 is arranged between the upper axial hole 121 and the axial hole 31. Water seals 81 are arranged between the driving shaft 80 and the upper axial hole 121 and the axial hole 31 respectively. The driving shaft 80 has a central water path 82 having an upward open. A bottom of the driving shaft 80 has a gear 83, and the gear 83 is in the second upper receiving chamber 12. A plurality of lateral hole 84 is formed to a peripheral of a middle of the driving shaft 80 which communicates with the central water path 82. The plurality of lateral hole 84 is in the upper independent chamber 400. A plurality of protruded tooth 85 is formed near to an upper end of the driving shaft 80 for connecting a nozzle 700 as shown in FIGS. 24 and 25.

Referring to FIGS. 1, 2, 4, and 5, the lower cover 40 has a ring tank 41 having an upward open. A top of the lower cover 40 is fixed to the lower receiving space 24 of the lower tube 20 so as to form a lower independent chamber 500. A top of the lower independent chamber 500 communicates with the clockwise water path 26, count-clockwise water path 27, and the lower water path 23. The ring tank 41 can receive a vane gear 90. A column axle 91 and an upper gear 92 are from above a center of the vane gear 90. The column axle 91 can be fit into the lower axial hole 221 of the lower tube 20, and the upper gear 92 is in the second lower receiving chamber 22 of the lower tube 20.

While the upper and lower tubes 10 and 20 are assembled in one, the first upper receiving chamber 11 and the first lower receiving chamber 21 are combined as the first independent chamber 100 and the second upper receiving chamber 12 and the second lower receiving chamber 22 are combined as the second independent chamber 200. The first and second upper axial holes 122 and 123 are aligned with the first and second lower axial holes 222 and 223 so as to receive a transmission gear 600 shown in FIG. 23. A bottom of the transmission gear 600 is engaged by the upper gear 92 of the vane gear 90. A top of the transmission gear 600 can be engaged by the gear 83 of the driving shaft 80. The upper water path 13 and the lower water path 23 are combined as the integral water path 300.

Therefore, water flow came into the first independent chamber 100 through the outer ring water path 25 of the lower receiving chamber 24 inside the lower tube 20 will be guided into the lower independent chamber 500 through the clockwise water path 26 or the count-clockwise water path 27. The vane gear 90 will be rotated clockwise or counterclockwise by the direction of the water flow. In the mean time, water flow will go into the integral water path 300 and reach the upper independent chamber 500. Finally, water flow will go into central water path 82 to the nozzle through the plurality of lateral hole 84.

Moreover, a plurality of through hole 42 is formed to a bottom of the lower cover 40. A protruded axle 43 is formed to an outer bottom of the lower cover 40. A compress spring 44 and a ring washer 45 are slid to the protruded axle 43. A bottom tube 60 is connected to the bottom of the lower tube 20. The bottom tube 60 has a round buffer tank 61 on a top thereof. A round hole 62 linking to a bottom tube hole 63 is formed to a bottom of the buffer tank 61. A plurality of round hole 64 is formed to a peripheral of the buffer tank 61 between the bottom tube hole 63. The plurality of round hole 64 communicates with the bottom tube hole 63. An independent chamber is formed between the buffer tank 61 and the bottom of the lower cover 40, the ring washer 45 will seal the round hole 62 of the buffer tank 61.

Therefore, while water supplied from the ring hole 64 of bottom tube 60 being sprinkled out of the central water path 82 of the driving shaft 80 through the outer ring water path 25 of the lower tube 20, excess water pressure can push the round washer 45 so that excess pressurized water will flow into the buffer tank 61 so as to be drained through the lower independent chamber 500. While the water pressure is back to normal, the round washer 45 pushed by the compress spring 44 will seal the round hole 62 again so as to automatically adjust water pressure.

Figure 23:
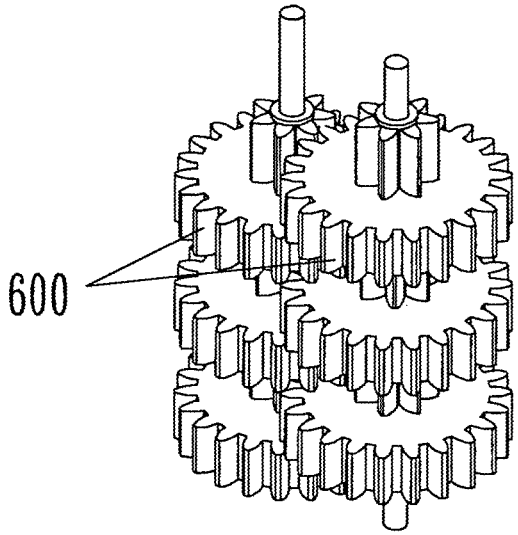
FIG. 23 is a schematic view showing a preferable embodiment of a transmission gear of the present invention.

Moreover, the transmission gear of the present invention shown in FIG. 23 is arranged by two sets of gear engaging to each other. Each gear set has a plurality of double-layer gear serially link by an axle, and the two axles are received by the first upper and lower axial holes and the second upper and lower axial holes respectively.

The embodiment of the water passage for embedded rotary sprinkler according to the present invention is shown in FIGS. 24 and 25.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An embedded rotary sprinkler, comprising:

an upper tube having a first upper receiving chamber, an upper independent chamber, a top receiving chamber formed above said first upper receiving chamber, a through hole formed between said first receiving chamber and said top receiving chamber, wherein said upper tube defines an upper water path, and further comprises a rod moveably mounted to said through hole, and a water seal ring mounted between said rod and a side wall of said through hole;

a lower cover;

a lower tube having a first lower receiving chamber, a second independent chamber, a lower receiving space, and defining a lower water path, wherein said upper tube and said lower tube are arranged to be connected with each other to allow said first upper receiving chamber and said first lower receiving chamber to communicate with each other to form a first independent chamber, while said upper water path and said lower water path are arranged to communicate with each other to form an integral water path;

a lower independent chamber communicating with said first independent chamber, wherein said embedded rotary sprinkler defines an integral water path communicating with said upper independent chamber and said lower independent chamber for forming a circuitous path of water in said embedded rotary sprinkler; and a protruded axle formed on an outer bottom of said lower cover, a compress spring and a washer slidably mounted on said protruded axle, and a bottom tube connected to a bottom portion of said lower tube, wherein said lower cover has a plurality of through holes formed on a bottom portion thereof, wherein said bottom tube has a buffer tank formed on a top thereof and defines a bottom tube hole, wherein a bottom hole linking to said bottom tube hole is formed to a bottom of said buffer tank, wherein a plurality of peripheral holes is formed to a peripheral of said buffer tank between said bottom tube hole, wherein said washer is capable of sealing said bottom hole of said buffer tank, while water supplied from said peripheral holes of said bottom tube being sprinkled out through said upper independent chamber, excess water pressure pushes said washer so that excess pressurized water flows into said buffer tank so as to be drained through said lower independent chamber which communicates with said first independent chamber.

2. The embedded rotary sprinkler, as recited in claim 1, wherein said upper tube further has a second upper receiving chamber, while said lower tube further has a second lower receiving chamber, wherein said second upper receiving chamber and said second lower receiving chamber are combined to form said second independent chamber.

3. The embedded rotary sprinkler, as recited in claim 2, further comprising an upper cover provided on top of said top receiving chamber so that said upper independent chamber is formed between said upper cover and a relative top of said second upper receiving chamber, wherein a bottom portion of said upper independent chamber is arranged to communicate with said integral water path.

4. The embedded rotary sprinkler, as recited in claim 3, wherein said upper tube further has an upper axial through hole formed on a top side of said second upper receiving chamber, a first upper axial hole and a second upper axial hole spacedly formed in a vicinity of said upper axial through hole.

5. The embedded rotary sprinkler, as recited in claim 4, further comprising an awl-shaped column, and a splitter, wherein a bottom portion of said lower receiving space is connected to said bottom tube, wherein a top portion of said lower receiving space is connected to said bottom tube, wherein a top portion of said lower receiving space defines a linked outer ring water path, a clockwise water path, and a counterclockwise water path, wherein said awl-shaped column is formed between said clockwise water path and said counterclockwise water path, wherein said splitter is arranged to said awl-shaped column.

6. An embedded rotary sprinkler, comprising:

an upper tube having a first upper receiving chamber, an upper independent chamber, a top receiving chamber formed above said first upper receiving chamber, a through hole formed between said first receiving chamber and said top receiving chamber, wherein said upper tube defines an upper water path, and further comprises a rod moveably mounted to said through hole, and a water seal ring mounted between said rod and a side wall of said through hole;

a lower cover;

a lower tube having a first lower receiving chamber, a second independent chamber, a lower receiving space, and defining a lower water path, wherein said upper tube and said lower tube are arranged to be connected with each other to allow said first upper receiving chamber and said first lower receiving chamber to communicate with each other to form a first independent chamber, while said upper water path and said lower water path are arranged to communicate with each other to form an integral water path;

a lower independent chamber communicating with said first independent chamber, wherein said embedded rotary sprinkler defines an integral water path communicating with said upper independent chamber and said lower independent chamber for forming a circuitous path of water in said embedded rotary sprinkler, wherein said upper tube further has a second upper receiving chamber, while said lower tube further has a second lower receiving chamber, wherein said second upper receiving chamber and said second lower receiving chamber are combined to form said second independent chamber;

an upper cover provided on top of said top receiving chamber so that said upper independent chamber is formed between said upper cover and a relative top of said second upper receiving chamber, wherein a bottom portion of said upper independent chamber is arranged to communicate with said integral water path, wherein said upper tube further has an upper axial through hole formed on a top side of said second upper receiving chamber, a first upper axial hole and a second upper axial hole spacedly formed in a vicinity of said upper axial through hole;

a bottom tube, an awl-shaped column, and a splitter, wherein a bottom portion of said lower receiving space is connected to said bottom tube, wherein a top portion of said lower receiving space is connected to said bottom tube, wherein a top portion of said lower receiving space defines a linked outer ring water path, a clockwise water path, and a counterclockwise water path, wherein said awl-shaped column is formed between said clockwise water path and said counterclockwise water path, wherein said splitter is arranged to said awl-shaped column; and a twisting sheet, while said splitter has a recess formed on a top portion thereof and is connected to said twisting sheet, wherein said twisting sheet is linked to said rod and is arranged to drive said splitter to selectively block one of said clockwise water path and said counterclockwise water path, wherein said splitter further has a awl-shaped recess formed on a bottom portion of said splitter for engaging with said awl-shaped column.

7. The embedded rotary sprinkler, as recited in claim 6, wherein said lower tube further has a lower axial hole formed on a bottom portion of said second lower receiving chamber, a first lower axial hole and a second lower axial hole formed adjacent to said lower axial hole, wherein said lower water path is formed at two lateral sides of said first and said second lower receiving chambers, wherein a bottom portion of said lower water path communicates with said lower receiving chamber.

8. The embedded rotary sprinkler, as recited in claim 7, wherein said rod has a recess formed at a bottom portion thereof for receiving a top portion of said twisting sheet.

9. The embedded rotary sprinkler, as recited in claim 8, further comprising a driving shaft, a gear, and a plurality of water seals, wherein said upper cover has an axial hole, wherein said driving shaft is arranged between said upper axial hole and said axial hole, wherein said water seals are arranged between said driving shaft and said upper axial hole and said axial hole respectively, wherein said driving shaft has a central water path having an upward opening, wherein said gear is provided at a bottom portion of said driving shaft in said second upper receiving chamber, wherein said shaft has a plurality of lateral hole formed to a peripheral of a middle of said driving shaft and is arranged to communicate with said central water path, wherein said driving shaft further has a plurality of protruded tooth formed at an upper end thereof for connecting a nozzle.

10. The embedded rotary sprinkler, as recited in claim 9, further comprising a vane gear which comprises a column axle, and an upper gear, wherein said lower cover has a ring tank having an upward opening, wherein a top portion of said lower cover is fixed to said lower receiving space of said lower tube so as to form said lower independent chamber, wherein said ring tank is arranged to receive said vane gear, wherein said column axle is fitted into said lower axial hole of said lower tube, and said upper gear is mounted in said second lower receiving chamber of said lower tube.

11. The embedded rotary sprinkler, as recited in claim 10, further comprising a transmission gear, wherein said first and said second upper axial hole are aligned with said first and said second lower axial hole for receiving said transmission gear, wherein a bottom portion of said transmission gear is engaged by said upper gear of said vane gear, wherein a top portion of said transmission gear is engaged by said gear of said driving shaft, wherein water is guided to flowing into said first independent chamber through said outer ring water path of said lower receiving chamber inside said lower tube and into said lower independent chamber through one of said clockwise water path and said counterclockwise water path, wherein said vane gear is rotated according to a direction of said water flow, wherein water is then is guided to flow into said integral water path and reach said upper independent chamber, wherein said water flowing into said upper independent chamber is then guided to flow into said central water path to said nozzle.

12. The embedded rotary sprinkler, as recited in claim 11, further comprising a protruded axle formed on an outer bottom of said lower cover, a compress spring and a ring washer slidably mounted on said protruded axle, wherein said bottom tube is connected to a bottom portion of said lower tube, wherein said lower cover has a plurality of through holes formed on a bottom portion thereof, wherein said bottom tube has a round buffer tank formed on a top thereof, a plurality of round holes, and a bottom tube hole linking to said round holes is formed on a bottom portion of said buffer tank, wherein said ring washer is arranged to seal said round hole of said buffer tank.

13. An embedded rotary sprinkler, comprising:

an upper tube having a first upper receiving chamber, an upper independent chamber, a top receiving chamber formed above said first upper receiving chamber, a through hole formed between said first receiving chamber and said top receiving chamber, wherein said upper tube defines an upper water path, and further comprises a rod moveably mounted to said through hole, and a water seal ring mounted between said rod and a side wall of said through hole;

a lower cover;

a lower tube having a first lower receiving chamber, a second independent chamber, a lower receiving space, and defining a lower water path, wherein said upper tube and said lower tube are arranged to be connected with each other to allow said first upper receiving chamber and said first lower receiving chamber to communicate with each other to form a first independent chamber, while said upper water path and said lower water path are arranged to communicate with each other to form an integral water path; and a lower independent chamber communicating with said first independent chamber, wherein said embedded rotary sprinkler defines an integral water path communicating with said upper independent chamber and said lower independent chamber for forming a circuitous path of water in said embedded rotary sprinkler, wherein said embedded rotary sprinkler further comprises a bottom tube, an awl-shaped column, and a splitter, wherein a bottom portion of said lower receiving space is connected to said bottom tube, wherein a top portion of said lower receiving space is connected to said bottom tube, wherein a top portion of said lower receiving space defines a linked outer ring water path, a clockwise water path, and a counterclockwise water path, wherein said awl-shaped column is formed between said clockwise water path and said counterclockwise water path, wherein said splitter is arranged to said awl-shaped column, wherein said embedded rotary sprinkler further comprises a twisting sheet, while said splitter has a recess formed on a top portion thereof and is connected to said twisting sheet, wherein said twisting sheet is linked to said rod and is arranged to drive said splitter to selectively block one of said clockwise water path and said counterclockwise water path, wherein said splitter further has an awl-shaped recess formed on a bottom portion of said splitter for engaging with said awl-shaped column.

14. The embedded rotary sprinkler, as recited in claim 13, further comprising a protruded axle formed on an outer bottom of said lower cover, a compress spring and a washer slidably mounted on said protruded axle, wherein said bottom tube is connected to a bottom portion of said lower tube, wherein said lower cover has a plurality of through holes formed on a bottom portion thereof, wherein said bottom tube has a buffer tank formed on a top thereof and defines a bottom tube hole, wherein a bottom hole linking to said bottom tube hole is formed to a bottom of said buffer tank, wherein a plurality of peripheral holes is formed to a peripheral of said buffer tank between said bottom tube hole, wherein said washer is capable of sealing said bottom hole of said buffer tank, while water supplied from said peripheral holes of said bottom tube being sprinkled out through said upper independent chamber, excess water pressure pushes said washer so that excess pressurized water flows into said buffer tank so as to be drained through said lower independent chamber which communicates with said first independent chamber.

15. The embedded rotary sprinkler, as recited in claim 14, wherein said upper tube further has a second upper receiving chamber, while said lower tube further has a second lower receiving chamber, wherein said second upper receiving chamber and said second lower receiving chamber are combined to form said second independent chamber.

16. The embedded rotary sprinkler, as recited in claim 15, further comprising an upper cover arranged to said top receiving chamber so that said upper independent chamber is formed between said upper cover and a relative top of said second upper receiving chamber, wherein a bottom portion of said upper independent chamber is arranged to communicate with said integral water path.

17. The embedded rotary sprinkler, as recited in claim 16, wherein said upper tube further has an upper axial through hole formed on a top side of said second upper receiving chamber, a first upper axial hole and a second upper axial hole spacedly formed in a vicinity of said upper axial through hole.

18. The embedded rotary sprinkler, as recited in claim 17, further comprising an awl-shaped column, and a splitter, wherein a bottom portion of said lower receiving space is connected to said bottom tube, wherein a top portion of said lower receiving space is connected to said bottom tube, wherein a top portion of said lower receiving space defines a linked outer ring water path, a clockwise water path, and a counterclockwise water path, wherein said awl-shaped column is formed between said clockwise water path and said counterclockwise water path, wherein said splitter is arranged to said awl-shaped column.

19. The embedded rotary sprinkler, as recited in claim 18, wherein said lower tube further has a lower axial hole formed on a bottom portion of said second lower receiving chamber, a first lower axial hole and a second lower axial hole formed adjacent to said lower axial hole, wherein said lower water path is formed at two lateral sides of said first and said second lower receiving chambers, wherein a bottom portion of said lower water path communicates with said lower receiving chamber.

20. The embedded rotary sprinkler, as recited in claim 19, wherein said rod has a recess formed at a bottom portion thereof for receiving a top portion of said twisting sheet.

* * * * *